US007504595B2

(12) United States Patent
Lu et al.

(10) Patent No.: US 7,504,595 B2
(45) Date of Patent: Mar. 17, 2009

(54) SWITCHING SIGNAL INPUT DEVICE FOR USE WITH ELECTRONIC APPARATUS

(75) Inventors: Chang Kun Lu, Taipei (TW); Wen Shin Wang, Taipei (TW)

(73) Assignee: Transpacific Plasma, LLC, Taipei (TW)

( * ) Notice: Subject to any disclaimer, the term of this patent is extended or adjusted under 35 U.S.C. 154(b) by 1 day.

(21) Appl. No.: 11/550,515

(22) Filed: Oct. 18, 2006

(65) Prior Publication Data

US 2007/0131525 A1 Jun. 14, 2007

Related U.S. Application Data

(63) Continuation of application No. 11/075,713, filed on Mar. 10, 2005, now Pat. No. 7,173,199.

(30) Foreign Application Priority Data

Jan. 7, 2005 (TW) ..... 94100430 A

(51) Int. Cl.
*H01H 13/70* (2006.01)
*H01H 25/00* (2006.01)
*H01H 25/04* (2006.01)

(52) U.S. Cl. ..... 200/5 R; 200/17 R; 200/329; 200/5 A

(58) Field of Classification Search ..... 200/5 R
See application file for complete search history.

(56) References Cited

U.S. PATENT DOCUMENTS

| | | | | |
|---|---|---|---|---|
| 6,344,620 | B1 * | 2/2002 | Nakamura | 200/6 A |
| 6,670,893 | B1 * | 12/2003 | Svarfvar | 341/22 |
| 6,744,890 | B1 * | 6/2004 | Le et al. | 379/433.07 |
| 6,953,900 | B2 * | 10/2005 | Sottong | 200/5 R |
| 7,148,880 | B2 * | 12/2006 | Magara | 345/161 |
| 7,173,199 | B2 * | 2/2007 | Lu et al. | 200/1 R |

* cited by examiner

*Primary Examiner*—Elvin G Enad
*Assistant Examiner*—Lheiren Mae A Anglo
(74) *Attorney, Agent, or Firm*—Workman Nydegger

(57) ABSTRACT

A switching signal input device for use with an electronic apparatus is provided. The switching signal input device includes a switch part, an operating part and a resilience element, and is capable of performing four-directional switch control actions in response to the elastic forces generated from the resilience element on two planes perpendicular to each other.

21 Claims, 3 Drawing Sheets

SWITCHING SIGNAL INPUT DEVICE FOR USE WITH ELECTRONIC APPARATUS

FIELD OF THE INVENTION

The present invention relates to a switching signal input device, and more particularly to a switching signal input device for use with an electronic apparatus.

BACKGROUND OF THE INVENTION

Generally, electronic apparatuses such as MP3 players, subscriber identity module (SIM) card readers and the like have user operation interfaces for users to control for example volume or function selection of the electronic apparatuses. These electronic apparatuses are usually controlled in response to switching signals. The user operation interfaces of the touch switches, for example touch pads, knobs and the like, are usually mounted on the electronic apparatuses. In other words, by controlling these user operation interfaces, the touch switches will be triggered to generate switching signals.

Conventionally, the switch operation interface is a disc-shaped touch pad having several (for example four) touch points. Each touch point correlates to a switch. In response to a depressing operation, the corresponding switch is triggered to generate a switching signal. This approach, however, has some drawbacks. For example, the touch pad occupies much area. In addition, some users may have problem in operating the touch pad to control the electronic apparatus.

Another switch operation interface having rotary means is convenient for other users. Such a switch operation interface has a rotatable control rod rotated to trigger the switch. The conventional rotary means for triggering the switch, however, can only provide three-directional switch control actions, i.e. levorotary, dextrorotary and pushing control actions. The number of the switch control actions for a user to perform is limited.

SUMMARY OF THE INVENTION

It is an object of the present invention to provide a switching signal input device for use with an electronic apparatus to allow the user to perform four-directional switch control actions.

Another object of the present invention is to provide a four-directional switching signal input device for use with an electronic apparatus, which is simple in configuration.

In accordance with a first aspect of the present invention, there is provided a switching signal input device for use with an electronic apparatus. The switching signal input device comprises a switch part, an operating part and a resilience element. The switch part comprises a circuit board, two forward switches disposed on a first surface of the circuit board, and two lateral switches disposed on a second surface of the circuit board. The operating part comprises an operating rod operated by a user to control the switching signal input device, and a touch portion coupled to the operating rod for touching one switch of the switch part upon the operating rod is operated by the user. The resilience element is used for generating elasticity on first and second planes perpendicular to each other, and comprises a U-shaped portion parallel with the first plane to have the operating part clamped and supported by the resilience element such that the operating rod is operated to perform a levorotary or dextrorotary action on the first plane and a forward or backward shifting action on the second plane.

In an embodiment, the operating part further comprises a trench structure for clamping and supporting the resilience element.

In an embodiment, the touch portion comprises a forward switch touch portion and a lateral switch touch portion. The forward switch touch portion has a hook portion touching the two forward switches when the operating rod is moved forwardly or backwardly on the second plane. The lateral switch touch portion having two symmetrical slants touching the two lateral switches when the operating rod is rotated on the first plane.

In an embodiment, the operating rod, the trench structure and the touch portion of the operating part are integrally formed.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
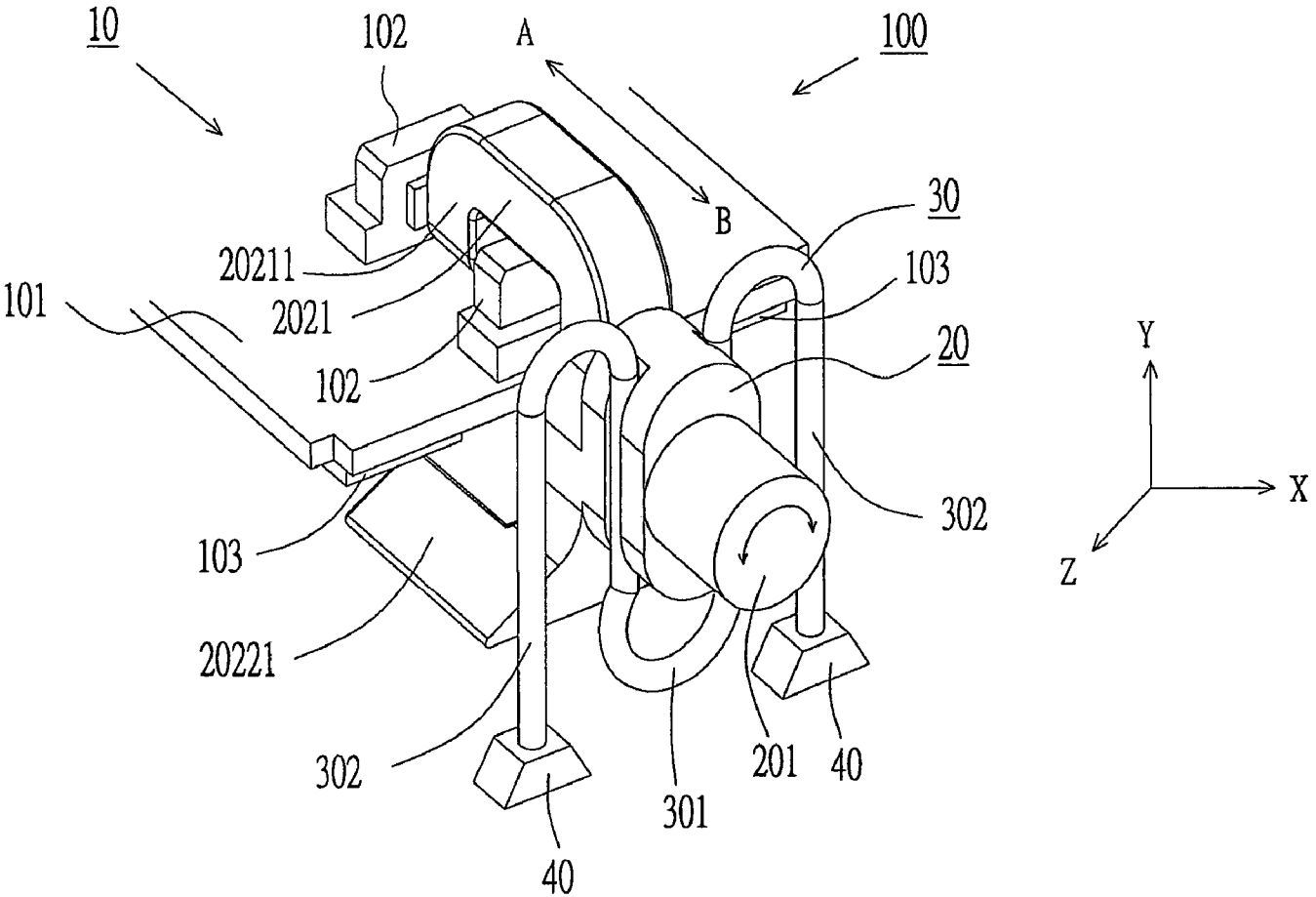
FIG. 1 schematically illustrates a perspective view of a switching signal input device according to a preferred embodiment of the present invention.

Referring to FIG. 1, a perspective view of a switching signal input device according to a preferred embodiment of the present invention is shown. The switching signal input device 100 in FIG. 1 comprises a switch part 10, an operating part 20 and a resilience element 30.

The switch part 10 comprises a circuit board 101, two forward switches 102 and two lateral switches 103. The forward switches 102 are disposed on the top surface of the circuit board 101. Whereas, the lateral switches 103 are disposed on the bottom surface of the circuit board 101.

Figure 2:
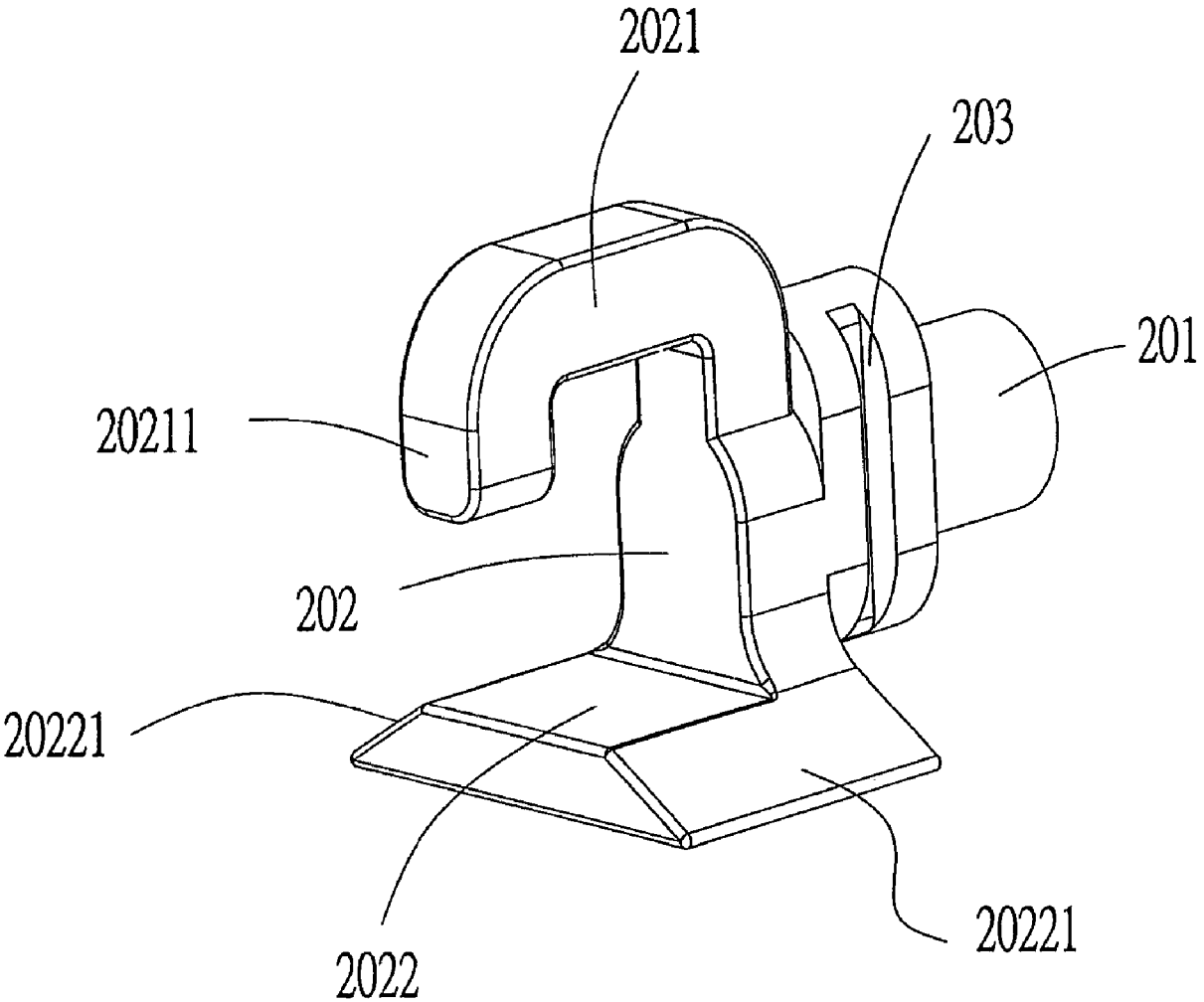
FIG. 2 schematically illustrates the touch potion of the switching signal input in FIG. 1.

Please refer to FIG. 2, which schematically illustrates an exemplary operating part 20 of the present invention. The operating part 20 comprises an operating rod 201, a touch portion 202 and a trench structure 203. In this embodiment, the touch portion 202 comprises a forward switch touch portion 2021 and a lateral switch touch portion 2022. The forward switch touch portion 2021 has a hook portion 20211 selectively touching the forward switches 102. The lateral switch touch portion 2022 has two symmetrical slants 20221 selectively touching the lateral switches 103. Preferably, the components of the operating part 20 are integrally formed into a one-piece part.

Please refer to FIG. 1 again. The resilience element 30 comprises a U-shaped portion 301. Two resilience arms 302 are extended from both ends of the U-shaped portion 301, respectively. By means of these two resilience arms 302, the resilience element 30 is fixed within an electronic apparatus via for example the fixture portions 40.

Figure 3B:
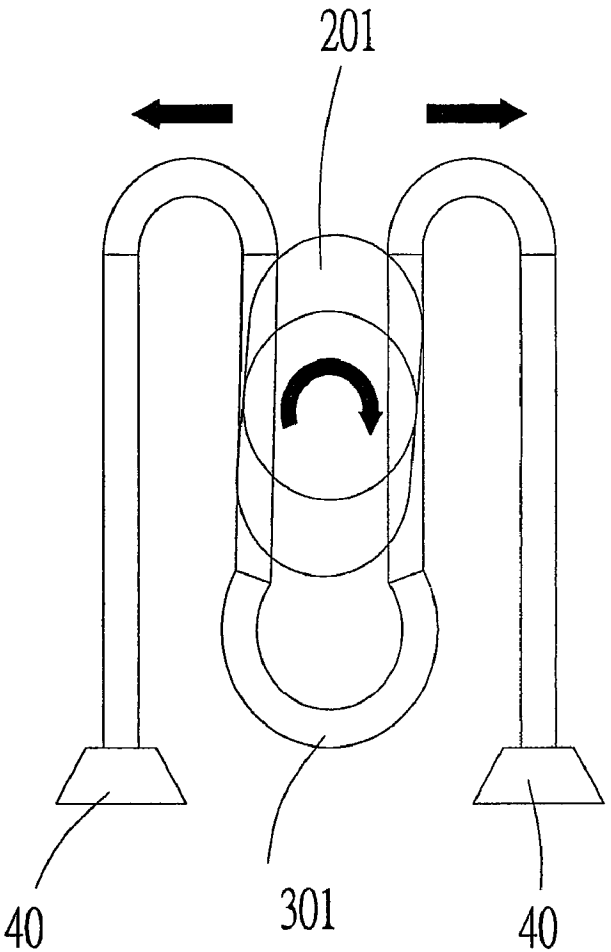
FIG. 3B schematically illustrates deformation of the resilience element upon a dextrorotary operation is performed on the operating rod.
Figure 3A:
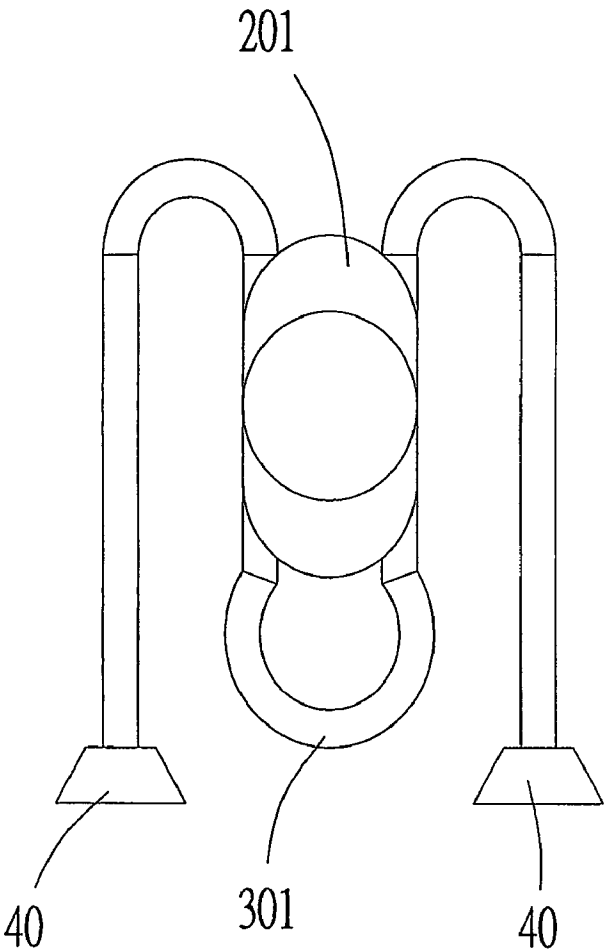
FIG. 3A schematically illustrates the operating rod which has not been operated.

Please refer to FIGS. 1, 3A and 3B. The resilience element 30 is disposed on a first plane, i.e. the X-Y plane, and both arms of the U-shaped portion 301 are embedded into the trench structures 203 of the operating part 20 so as to clamp and support the operating part 20 (as shown in FIG. 3A). The operating rod 201 will be rotated on the first plane when a levorotary or dextrorotary operation is performed thereon. For example, as shown in FIG. 3B, when a dextrorotary operation is performed on the operating rod 201, the U-shaped portion 301 of the resilience element 30 will be deformed such that the slants 20221 of the lateral switch touch portion 2022 is shifted to touch the lateral switch 103. Whereas, when the user loosens the operating rod 201, the deformation of the U-shaped portion 301 will be eliminated by the elastic force resulted from the resilience element 30 and thus the operating rod 201 is returned to its original location as shown in FIG. 3A. On the other hand, when the operating rod 201 is pushed to move forwardly in the direction of the arrow A on the second plane perpendicular to the first plane, i.e. the X-Z plane, the U-shaped portion 301 will be deformed such that the hook portion 20211 of the forward switch touch portion 2021 touches the forward switch 102. Once no force is acted on the operating rod 201, the deformation of the U-shaped portion 301 will be eliminated by the elastic force resulted from the resilience element 30 and thus the operating rod 201 is returned to its original location again. Alternatively, the operating rod 201 can be pulled to move in another direction as shown in the arrow B, and thus the U-shaped portion 301 will be deformed such that the hook portion 20211 of the forward switch touch portion 2021 touches another forward switch 102. Once no force is acted on the operating rod 201, the deformation of the U-shaped portion 301 will be eliminated by the elastic force resulted from the resilience element 30 and thus the operating rod 201 is returned to its original location again.

From the above description, it is understood that the switching signal input device of the present invention is capable of performing four-directional switch control in response to the elastic forces generated from the resilience element 30 on two planes perpendicular to each other. When the switching signal input device of the present invention is applied to an electronic apparatus, only one operating rod 201 is sufficient to have the user perform four-directional switch control actions including levorotary, dextrorotary, push and pull control actions. Therefore, the user operation interface is simplified and the appearance of the electronic apparatus is more aesthetically pleasing. Moreover, the constituent components of the overall switching signal input device are simplified and thus the fabricating cost thereof is reduced.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. An input device for use with an electronic apparatus that enables four-directional control actions, the input device comprising:

an operating part including:

an operating rod;

a touch portion coupled to the operating rod;

a support structure formed in a side of the operating rod; and a resilience element connected with the support structure, the resilience element including a U-shaped portion having arms embedded in the support structure, wherein the resilience element generates elastic forces that are applied at the support structure to return the operating part to an original location after levorotary, dextrorotary, push, and pull actions.

2. The input device of claim 1, wherein the levorotary, dextrorotary, push and pull actions deform the U-shaped portion and generate the elastic forces that return the operating part to the original location after the levorotary, dextrorotary, push and pull actions are released.

3. The input device of claim 2, wherein the support structure comprises a first trench structure and a second trench structure formed in the operating rod, wherein the arms of the U-shaped portion clamp the operating rod at the first and second trench structures to hold the operating part in the original location.

4. The input device of claim 3, wherein the resilience element further comprises a fixture portion connected with the arms, wherein the fixture portion fixes the resilience element to an electronic apparatus, wherein the operating part moves relative to the electronic device in response to the levorotary, dextrorotary, push, and pull actions.

5. The input device of claim 1, further comprising a switch part having a plurality of switches disposed on a circuit board, wherein the touch portion controls switching with the plurality of switches in response to the levorotary, dextrorotary, push, and pull actions.

6. The input device of claim 5, wherein the touch portion comprises a hook switch touch portion positioned over a first side of the circuit board and a lateral switch touch portion positioned over a second side of the circuit board.

7. The input device of claim 6, wherein the plurality of switches comprises:

a first and second forward switch disposed on the first side of the circuit board, wherein the hook switch touch portion connects with the first forward switch in response to the push action and connects with the second forward switch in response to the pull action; and a first and second lateral switch disposed on the second side of the circuit board, wherein the lateral switch touch portion connects with the first lateral switch in response to the levorotary action and connects with the second lateral switch in response to the dextrorotary action.

8. An input device for use with an electronic apparatus that enables four-directional control actions, the input device comprising:

means for controlling a switch part to provide four-directional control actions; and means for generating elasticity that returns the means for controlling a switch part to an original position after experiencing any of the four-directional control actions, wherein the means for generating elasticity comprises a U-shaped portion having arms that clamp and support the means for controlling a switch part in the original position.

9. The input device of claim 8, wherein the means for controlling a switch part further comprises means for touching at least one switch included in the switch part.

10. The input device of claim 8, wherein the switch part further comprises forward switches mounted on a first side of a printed circuit board and lateral switches mounted on a second side of a printed circuit board.

11. The input device of claim 10, wherein the four-directional control actions include push, pull, levorotary, and dextrorotary actions, wherein the means for controlling a switch part further comprises a forward touch portion that touches the forward switches in response to push actions and pull actions and a lateral touch portion that touches the lateral switches in response to levorotary actions and dextrorotary actions.

12. The input device of claim 8, wherein the means for generating elasticity further comprises a resilience element connected with the means for controlling a switch part, wherein the resilience element deforms in at least one of a first plane and a second plane in response to any of the four-directional control actions.

13. The input device of claim 8, further comprising means for connecting the means for generating elasticity with the means for controlling a switch part such that the means for generating elasticity deforms in response to any of the four-directional control actions and provides an elastic force that returns the means for controlling a switch part to the original position.

14. The input device of claim 13, wherein the means for connecting further comprises trench structures formed in the means for controlling a switch part, wherein the means for generating elasticity is embedded in the trench structures to clamp and support the means for controlling a switch part in the original position.

15. An input device for use with an electronic apparatus that enables four-directional control actions, the input device comprising:

an operating part including:

an operating rod; and a touch portion coupled to the operating rod, the touch portion selectively touching different switches in response to different control actions; and a resilience element connected with the operating part, the resilience element including resilience arms that fix the resilience element in an electronic apparatus and a U-shaped portion connected with the resilience arms, wherein the resilience element holds the operating part in an original position and returns the operating part to the original position after the operating part has been displaced by the control actions.

16. The input device of claim 15, the operating part further comprising a support structure formed in a side of the operating part, wherein the resilience element is embedded in the support structure to clamp and support the operating part in the original position. element is embedded in the support structure to clamp and support the operating part in the original position.

17. The input device of claim 16, wherein displacement of the operating part in response to a particular control action causes the resilience element to exert an elastic force to return the operating part to the original position.

18. The input device of claim 15, wherein the four-directional control actions include a push action, a pull action, a levorotary action and a dextrorotary action, the touch portion farther comprising:

a forward touch portion that connects with a first forward switch in response to a push action and that connects with a second forward switch in response to a pull action; and a lateral touch portion that connects with a first lateral switch in response to a levorotary action and that connects with a second lateral switch in response to a dextrorotary action.

19. The input device of claim 15, wherein the U-shaped portion clamps and supports the operating part in the original position and wherein deformation of the U-shaped portion in response to the four-directional control actions generates an elastic force in the U-shaped portion that returns the operating part to the original position.

20. A switching signal input device for use with an electronic apparatus, said switching signal input device comprising:

a switch part comprising a circuit board, forward switches disposed on a first surface of said circuit board, and lateral switches disposed on a second surface of said circuit board;

an operating part comprising an operating rod operated by a user to control said switching signal input device, and a touch portion coupled to said operating rod for touching one switch of said switch part upon said operating rod is operated by said user;

a resilience element for generating elasticity on first and second planes perpendicular to each other, and comprising a U-shaped portion parallel with said first plane to have said operating part clamped and supported by said resilience element such that said operating rod is operated to perform a levorotary or dextrorotary action on said first plane and a forward or backward shifting action on said second plane;

a forward switch touch portion having a hook portion touching one of said forward switches when said operating rod is moved forwardly or backwardly on said second plane; and a lateral switch touch portion having two symmetrical slants touching one of said lateral switches when said operating rod is rotated on said first plane.

21. The switching signal input device according to claim 20 wherein said operating rod, said trench structure and said touch portion of said operating part are integrally formed.

* * * * *

UNITED STATES PATENT AND TRADEMARK OFFICE

CERTIFICATE OF CORRECTION

PATENT NO. : 7,504,595 B2
APPLICATION NO. : 11/550515
DATED : March 17, 2009
INVENTOR(S) : Lu et al.

It is certified that error appears in the above-identified patent and that said Letters Patent is hereby corrected as shown below:

Column 5
Claim 15, line 27, remove "and"
Claim 16, line 43, remove "element is embedded in the support"
Claim 16, remove in their entireties, lines 44-45

Column 6
Claim 18, line 4, change "farther" to --further--
Claim 20, line 29, change "upon" to --when--

Signed and Sealed this

Thirteenth Day of July, 2010

David J. Kappos

David J. Kappos
*Director of the United States Patent and Trademark Office*